US007905377B2

(12) United States Patent
Krondorfer et al.

(10) Patent No.: US 7,905,377 B2
(45) Date of Patent: Mar. 15, 2011

(54) FLYWHEEL DRIVEN NAILER WITH SAFETY MECHANISM

(75) Inventors: Harald Krondorfer, Aurora, OH (US); John DeCicco, Elmhurst, IL (US); Eric Hlinka, Roselle, IL (US); Chia Sheng Liang, Taipei (TW)

(73) Assignee: Robert Bosch GmbH, Stuttgart (DE)

( * ) Notice: Subject to any disclaimer, the term of this patent is extended or adjusted under 35 U.S.C. 154(b) by 129 days.

(21) Appl. No.: 12/191,960

(22) Filed: Aug. 14, 2008

(65) Prior Publication Data

US 2010/0038397 A1 Feb. 18, 2010

(51) Int. Cl.
*B25C 1/06* (2006.01)

(52) U.S. Cl. ..... 227/8; 227/131; 227/147; 227/149; 173/90; 173/92; 173/117; 173/122

(58) Field of Classification Search ..... 173/90, 173/92, 1, 117, 122; 227/8, 131, 156, 2
See application file for complete search history.

(56) References Cited

U.S. PATENT DOCUMENTS 4,042,036 A 8/1977 Smith et al.
4,121,745 A 10/1978 Smith et al.
4,129,240 A 12/1978 Geist
4,161,272 A 7/1979 Brockl
4,189,080 A 2/1980 Smith et al.
4,204,622 A 5/1980 Smith et al.
4,290,493 A 9/1981 Smith et al.
4,298,072 A 11/1981 Baker et al.
4,323,127 A * 4/1982 Cunningham ..... 173/53
4,519,535 A 5/1985 Crutcher
4,544,090 A 10/1985 Warman et al.
4,721,170 A 1/1988 Rees
4,747,455 A * 5/1988 Cunningham ..... 173/1
5,069,379 A 12/1991 Kerrigan
5,098,004 A 3/1992 Kerrigan
5,191,209 A 3/1993 Rodseth et al.
5,415,136 A 5/1995 Doherty et al.
5,839,638 A 11/1998 Ronn
5,941,441 A 8/1999 Ilagan
6,116,488 A 9/2000 Lee
6,209,770 B1 4/2001 Perra
6,431,430 B1 8/2002 Jalbert et al.
6,671,163 B2 12/2003 Shkolnikow et al.
6,705,501 B2 3/2004 Miller et al.
6,705,503 B1 3/2004 Pedicini et al.
6,722,547 B1 4/2004 Wang et al.
6,766,935 B2 7/2004 Pedicini et al.
6,796,475 B2 * 9/2004 Adams ..... 227/2
6,929,165 B1 8/2005 Chen et al.
6,971,567 B1 12/2005 Cannaliato et al.

(Continued)

*Primary Examiner* — Brian D Nash
(74) *Attorney, Agent, or Firm* — Maginot, Moore & Beck

(57) ABSTRACT

A device for impacting a fastener in one embodiment includes a drive mechanism, a flywheel pivotable between a first flywheel position whereat the flywheel is not in contact with the drive mechanism and a second flywheel position whereat the flywheel contacts the drive mechanism, a motor operably connected to the flywheel, a trigger movable between a first trigger position and a second trigger position, and a WCE assembly movable between a first WCE position and a second WCE position, the WCE assembly configured such that (i) when the trigger is in the first trigger position and the WCE assembly is in the first WCE position, the WCE assembly mechanically engages the trigger to preclude movement of the trigger out of the first position, and (ii) when the WCE assembly is in the second WCE assembly position, the WCE assembly does not mechanically engage the trigger.

13 Claims, 8 Drawing Sheets

U.S. PATENT DOCUMENTS

| | | | | |
|---|---|---|---|---|
| 6,974,061 | B2 | 12/2005 | Adams et al. | |
| 7,070,080 | B2 | 7/2006 | Lin | |
| 7,138,595 | B2 * | 11/2006 | Berry et al. | 200/522 |
| 7,143,918 | B2 | 12/2006 | Aguirre et al. | |
| 7,213,733 | B1 | 5/2007 | Wen | |
| 7,285,877 | B2 | 10/2007 | Gorti et al. | |
| 7,331,403 | B2 * | 2/2008 | Berry et al. | 173/1 |
| 2002/0134811 | A1 | 9/2002 | Napier et al. | |
| 2002/0185514 | A1 * | 12/2002 | Adams et al. | 227/2 |
| 2004/0232194 | A1 | 11/2004 | Pedicini et al. | |
| 2005/0218177 | A1 * | 10/2005 | Berry et al. | 227/8 |
| 2005/0242154 | A1 * | 11/2005 | Leimbach | 227/131 |
| 2006/0180631 | A1 * | 8/2006 | Pedicini et al. | 227/130 |
| 2007/0007319 | A1 | 1/2007 | Simonelli et al. | |
| 2007/0095876 | A1 | 5/2007 | Oda et al. | |
| 2008/0067213 | A1 * | 3/2008 | Shima et al. | 227/129 |
| 2008/0122302 | A1 * | 5/2008 | Leininger | 310/50 |
| 2010/0038395 | A1 * | 2/2010 | Krondorfer et al. | 227/5 |
| 2010/0038397 | A1 * | 2/2010 | Krondorfer et al. | 227/8 |

* cited by examiner

FLYWHEEL DRIVEN NAILER WITH SAFETY MECHANISM

FIELD OF THE INVENTION

This invention relates to the field of devices used to drive fasteners into work-pieces and particularly to a device for impacting fasteners into work-pieces.

BACKGROUND

Fasteners such as nails and staples are commonly used in projects ranging from crafts to building construction. While manually driving such fasteners into a work-piece is effective, a user may quickly become fatigued when involved in projects requiring a large number of fasteners and/or large fasteners. Moreover, proper driving of larger fasteners into a work-piece frequently requires more than a single impact from a manual tool.

In response to the shortcomings of manual driving tools, power-assisted devices for driving fasteners into wood have been developed. Contractors and homeowners commonly use such devices for driving fasteners ranging from brad nails used in small projects to common nails which are used in framing and other construction projects. Compressed air has been traditionally used to provide power for the power-assisted devices. Specifically, a source of compressed air is used to actuate a cylinder which impacts a nail into the work-piece. Such systems, however, require an air compressor, increasing the cost of the system and limiting the portability of the system. Additionally, the air-lines used to connect a device to the air compressor hinder movement and can be quite cumbersome and dangerous in applications such as roofing.

Fuel cells have also been developed for use as a source of power for power-assisted devices. The fuel cell is generally provided in the form of a cylinder which is removably attached to the device. In operation, fuel from the cylinder is mixed with air and ignited. The subsequent expansion of gases is used to push the cylinder and thus impact a fastener into a work-piece. These systems are relatively complicated as both electrical systems and fuel systems are required to produce the expansion of gases. Additionally, the fuel cartridges are typically single use cartridges.

Another source of power that has been used in power assisted devices is electrical power. Traditionally, electrical devices have been mostly limited to use in impacting smaller fasteners such as staples, tacks and brad nails. In these devices, a solenoid driven by electrical power from an external source is used to impact the fastener. The force that can be achieved using a solenoid, however, is limited by the physical structure of the solenoid. Specifically, the number of ampere-turns in a solenoid governs the force that can be generated by the solenoid. As the number of turns increases, however, the resistance of the coil increases necessitating a larger operational voltage. Additionally, the force in a solenoid varies in relation to the distance of the solenoid core from the center of the windings. This limits most solenoid driven devices to short stroke and small force applications such as staplers or brad nailers.

Various approaches have been used to address the limitations of electrical devices. In some systems, multiple impacts are used. This approach requires the tool to be maintained in position for a relatively long time to drive a fastener. Another approach is the use of a spring to store energy. In this approach, the spring is cocked (or activated) through an electric motor. Once sufficient energy is stored within the spring, the energy is released from the spring into an anvil which then impacts the fastener into the substrate. The force delivery characteristics of a spring, however, are not well suited for driving fasteners. As a fastener is driven further into a work-piece, more force is needed. In contrast, as a spring approaches an unloaded condition, less force is delivered to the anvil.

Flywheels have also been used to store energy for use in impacting a fastener. The flywheels are used to launch a hammering anvil that impacts the nail. A shortcoming of such designs is the manner in which the flywheel is coupled to the driving anvil. Some designs incorporate the use of a friction clutching mechanism that is both complicated, heavy and subject to wear. Other designs use a continuously rotating flywheel coupled to a toggle link mechanism to drive a fastener. Such designs are limited by large size, heavy weight, additional complexity, and unreliability.

The foregoing advances provide increased maneuverability. Such maneuverability, however, implicates various safety issues. Specifically, as the tool becomes more portable, the tool is more likely to be transported to locations which are less safe. In such extended or precarious work sites, a substantial safety risk arises in that the natural human reflex when slipping or falling or losing balance in such precarious positions leads the operator to squeeze and grip the handle or handles of the power tool harder than usual. In many instances, operators subjected to falling or slipping actually instinctively lock onto the handle including the trigger actuator in a "death grip" type reflex action in which great force is applied to the trigger mechanism.

As a result of this tendency or reflex, an impacting device which is actuated solely by a trigger switch can be inadvertently actuated during an accident, leading to increased injuries. Additionally, mechanical switches which are typically used are subject to wear over time.

What is needed is a triggering system which can be used to control delivery of impacting force in a device which is reliable and safe and does not increase the number of mechanical switches. What is needed is a system which can be used to provide impacting force in a device using low voltage energy sources. What is further needed is a system which is reliable and does not require a continuously rotating flywheel.

SUMMARY

In accordance with one embodiment, there is provided a device for impacting a fastener including a drive mechanism, a flywheel pivotable between a first flywheel position whereat the flywheel is not in contact with the drive mechanism and a second flywheel position whereat the flywheel contacts the drive mechanism, a motor operably connected to the flywheel, a trigger movable between a first trigger position and a second trigger position, and a WCE assembly movable between a first WCE position and a second WCE position, the WCE assembly configured such that (i) when the trigger is in the first trigger position and the WCE assembly is in the first WCE position, the WCE assembly mechanically engages the trigger to preclude movement of the trigger out of the first position, and (ii) when the WCE assembly is in the second WCE assembly position, the WCE assembly does not mechanically engage the trigger.

In accordance with another embodiment, a method of impacting a fastener includes placing a trigger in a first trigger position, engaging the placed trigger with a work contact element (WCE) assembly, contacting a work piece with the WCE assembly, moving the WCE assembly out of engagement with the placed trigger based upon the work piece contact, moving the disengaged trigger from the first trigger position to a second trigger position, and moving a flywheel into contact with a drive mechanism based upon the trigger movement to the second trigger position.

In accordance with a further embodiment, a device for impacting a fastener includes a solenoid configured to pivot a lever arm between a first position whereat a flywheel is spaced apart from a drive mechanism and a second position whereat the flywheel can contact the drive mechanism, a motor operably connected to the flywheel for storing energy in the flywheel, a trigger movable between a first trigger position and a second trigger position, and a work contact element (WCE) assembly movable between a first WCE position for engaging the trigger and a second WCE position whereat the WCE assembly does not engage the trigger.

DESCRIPTION

Figure 1:
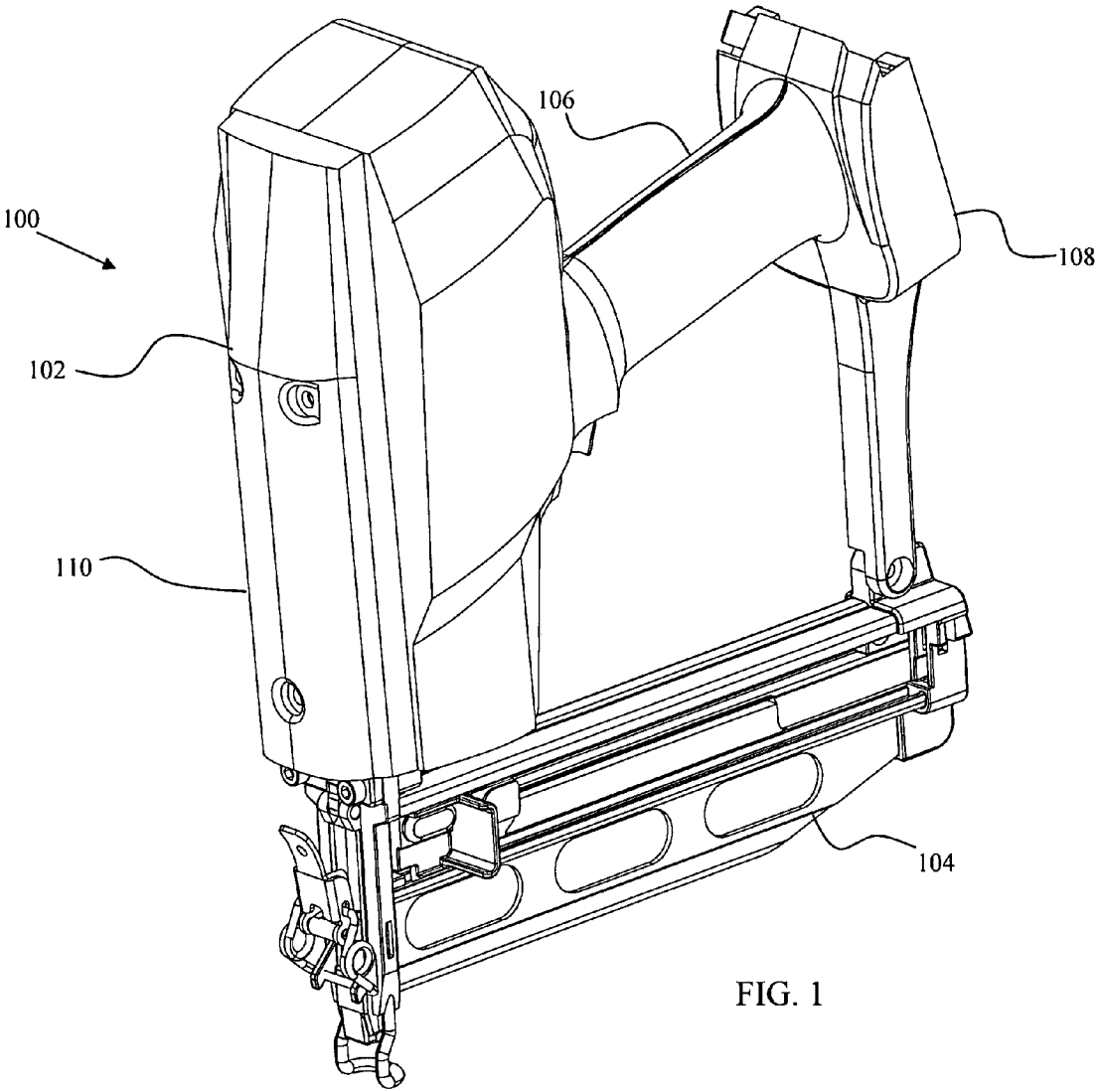
FIG. 1 depicts a front perspective view of a fastener impacting device in accordance with principles of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
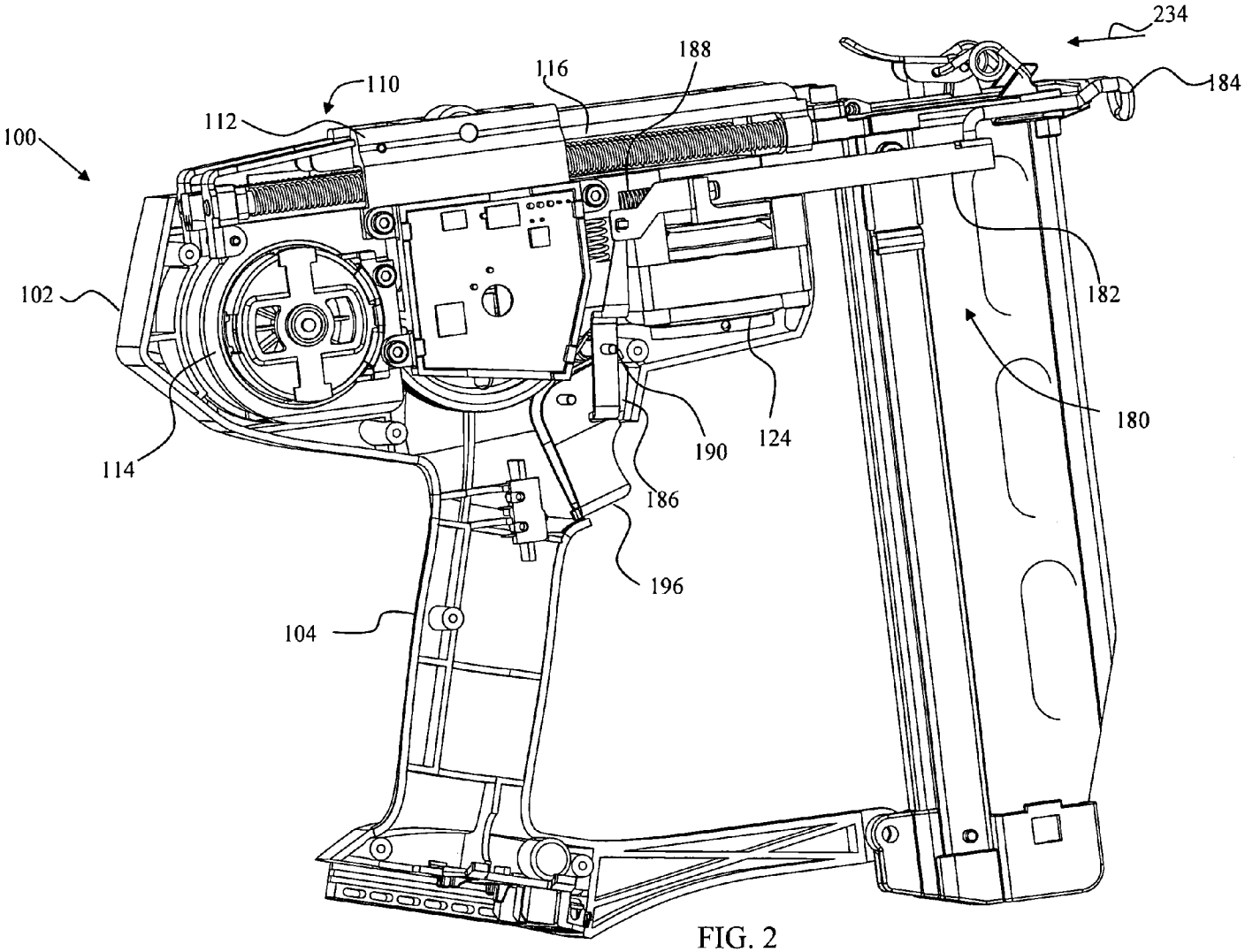
FIG. 2 depicts a side plan view of the fastener impacting device of FIG. 1 with a portion of the housing removed.
Figure 3:
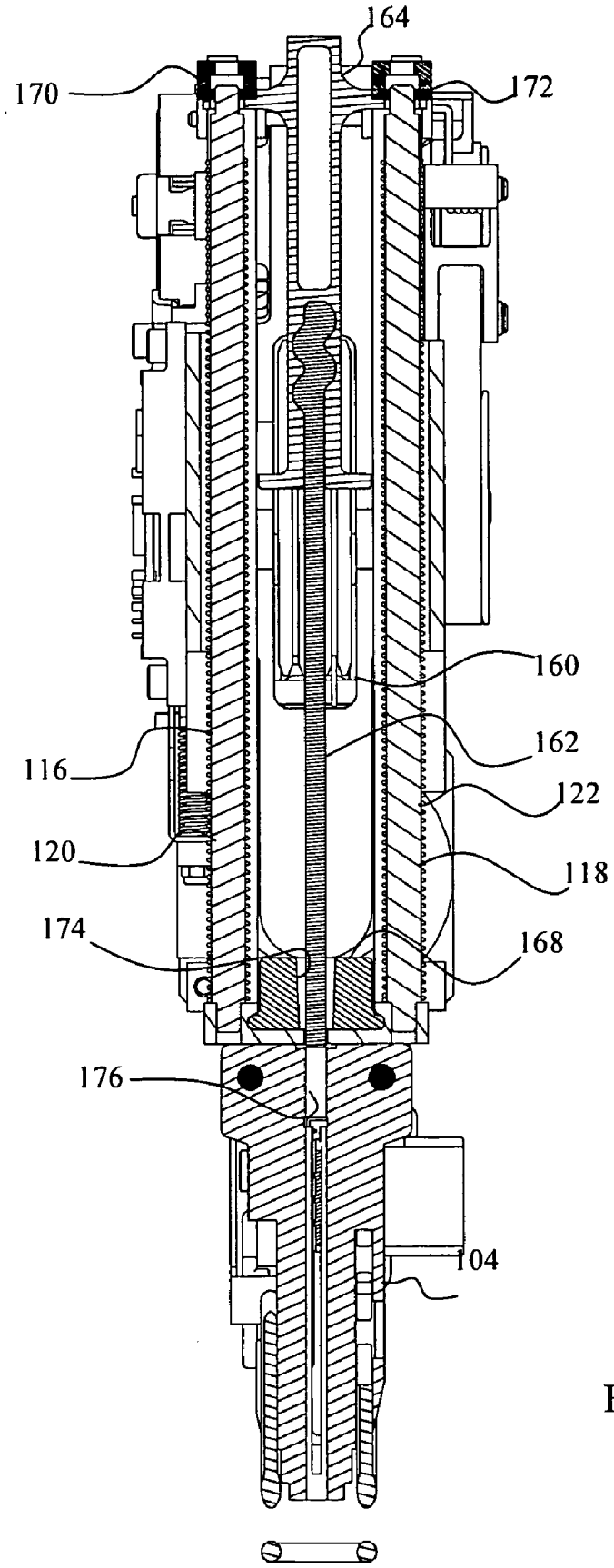
FIG. 3 depicts a top cross sectional view of the fastener impacting device of FIG. 1.

FIG. 1 depicts a fastener impacting device 100 including a housing 102 and a fastener cartridge 104. The housing 102 defines a handle portion 106, a battery receptacle 108 and a drive section 110. The fastener cartridge 104 in this embodiment is spring biased to force fasteners, such as nails or staples, serially one after the other, into a loaded position adjacent the drive section 110. With further reference to FIG. 2, wherein a portion of the housing 102 is removed, the housing 102 is mounted on a two piece frame 112 which supports a direct current motor 114. Two springs 116 and 118, shown more clearly in FIG. 3, are positioned about guides 120 and 122, respectively. A solenoid 124 is located below the guides 120 and 122.

Figure 4:
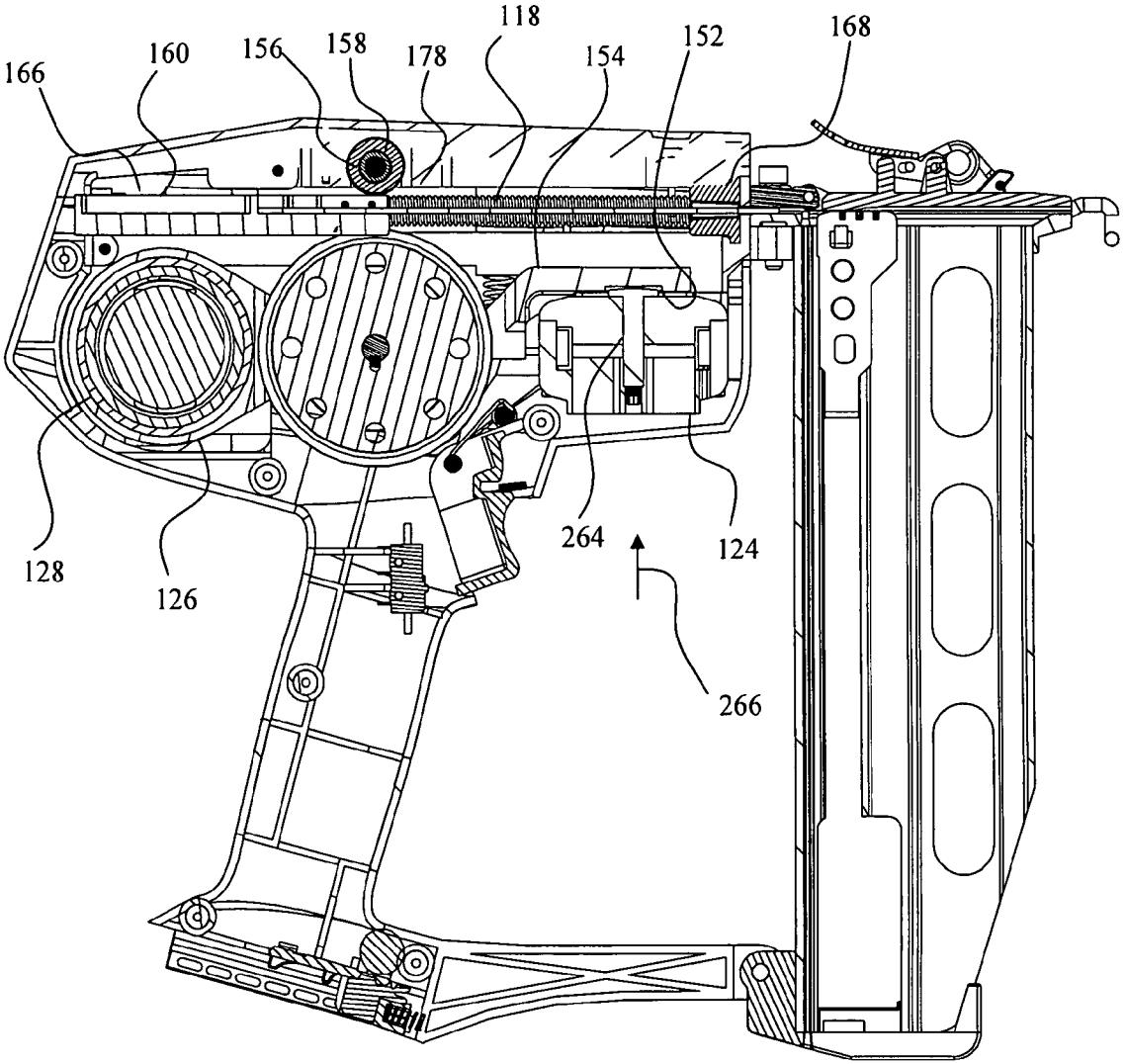
FIG. 4 depicts a side cross sectional view of the fastener impacting device of FIG. 1.
Figure 5:
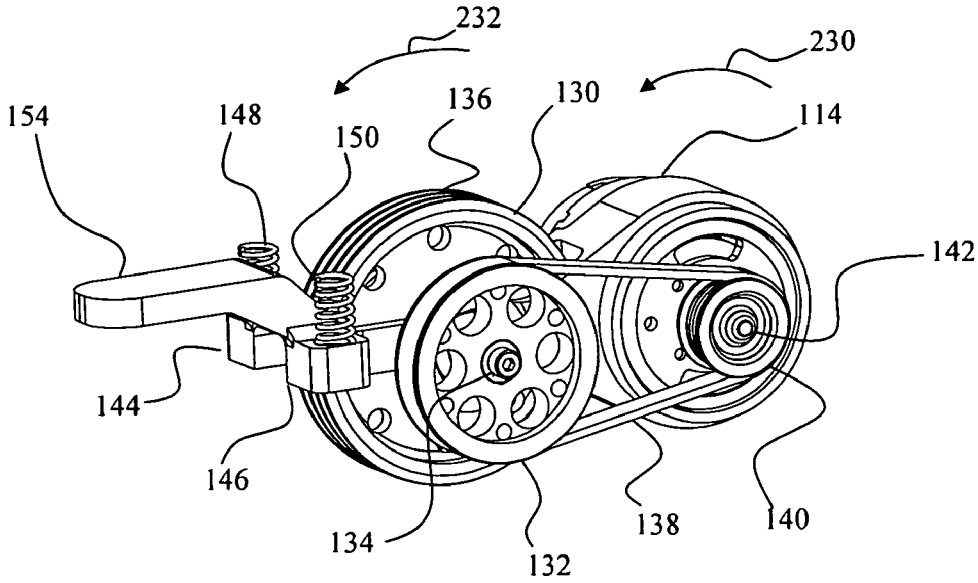
FIG. 5 depicts a front perspective view of the lever arm assembly of the device of FIG. 1.
Figure 6:
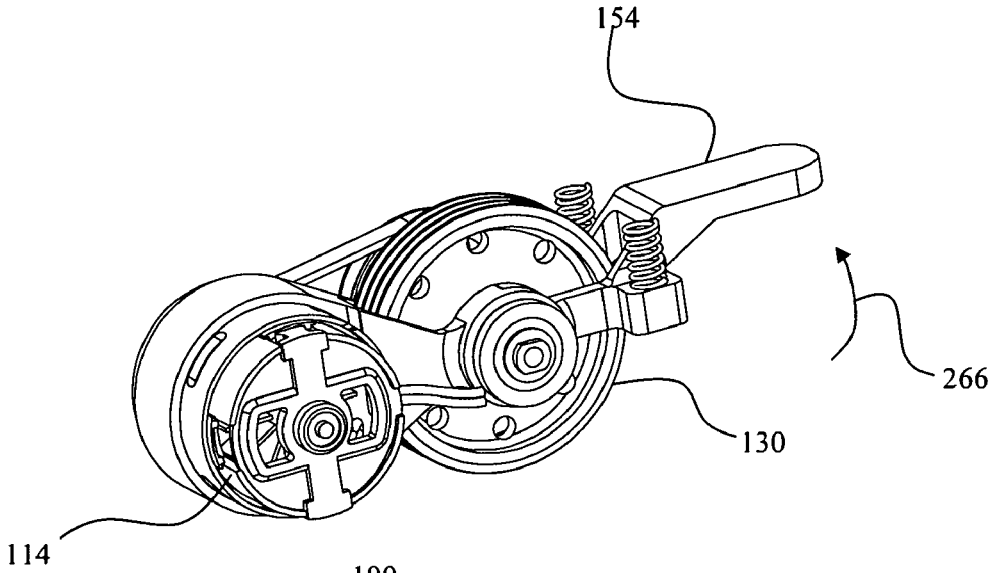
FIG. 6 depicts a rear perspective view of the lever arm assembly of the device of FIG. 1.

The motor 114, which is fixedly attached to the frame 112, rotatably supports a lever arm assembly 126 through a bearing 128 shown in FIG. 4. Referring additionally to FIGS. 5 and 6, the lever arm assembly 126 includes a flywheel 130 and a flywheel drive wheel 132 rotatably supported by an axle 134. A plurality of grooves 136 are formed in the outer periphery of the flywheel 130. A belt 138 extends between the flywheel drive wheel 132 and a drive wheel 140 attached to the output shaft 142 of the motor 114. The lever arm assembly 126 includes two spring wells 144 and 146 which receive springs 148 and 150, respectively. A pin receiving recess 152, which is best seen in FIG. 4, is located on the lower surface of a tongue 154.

Continuing with FIGS. 3 and 4, a free-wheeling roller 156 is rigidly mounted to the frame 112 through a bearing 158 at a location above a drive member 160. The drive member 160 includes an anvil 162 at one end and a guide rod flange 164 at the opposite end. A permanent magnet 166 is also located on the drive member 160. The drive member 160 is movable between a front bumper 168 located at the forward end portions of the guides 120 and 122 and a pair of rear bumpers 170 and 172 located at the opposite end portions of the guides 120 and 122. The front bumper 168 defines a central bore 174 which opens to a drive channel 176 in the fastener cartridge 104. A Hall effect sensor 178 is located forward of the free wheeling roller 156.

Referring to FIG. 2, an actuating mechanism 180 includes a slide bar 182 which is connected at one end to a work contact element (WCE) 184 and at the opposite end to a pivot arm 186. A spring 188 biases the slide bar 182 toward the WCE 184. The pivot arm 186 pivots about a pivot 190 and includes a hook portion 192 shown in FIG. 7. The hook portion 192 is configured to fit within a stop slot 194 of a trigger 196. The trigger 196 pivots about a pivot 198 and is aligned to activate a spring loaded switch 200.

Figure 8:
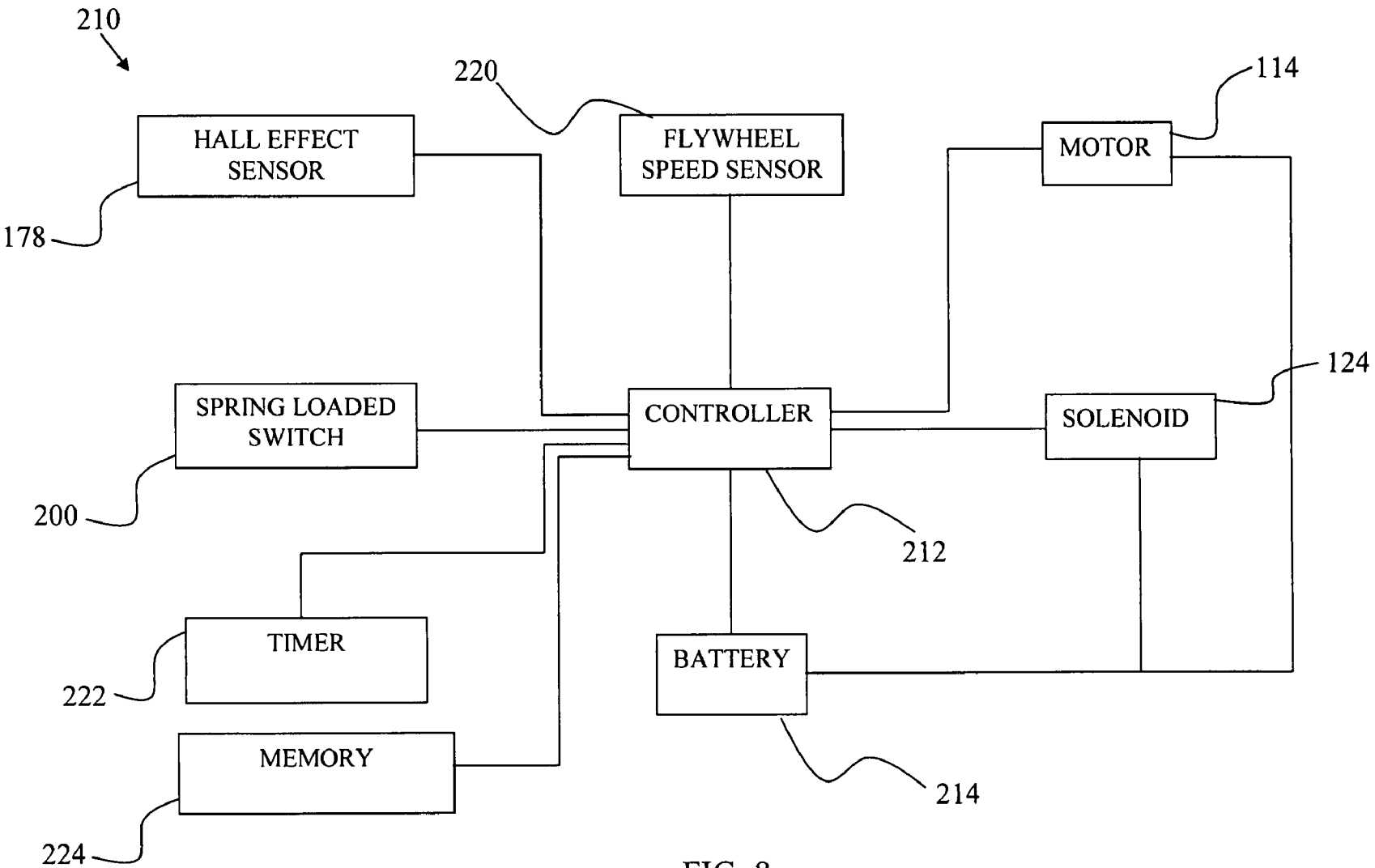
FIG. 8 depicts a schematic of a control system used to control the device of FIG. 1 in accordance with principles of the invention.

The spring loaded switch 200 is used to provide input to a control circuit 210 shown in FIG. 8. The control circuit 210 includes a processor 212 that controls the operation of the motor 114 and the solenoid 124. Power to the circuit 210 as well as the motor 114 and the solenoid 124, is provided by a battery 214 coupled to the battery receptacle 108 (see FIG. 1). The processor 212 receives a signal input from the spring loaded switch 200, the Hall effect sensor 178, and a flywheel speed sensor 220. The control circuit 210 further includes a timer 222 which provides input to the processor 212. A memory 224 is programmed with command instructions which, when executed by the processor 212, provide performance of various control functions described here. In one embodiment, the processor 212 and the memory 224 are onboard a microcontroller.

Figure 10:
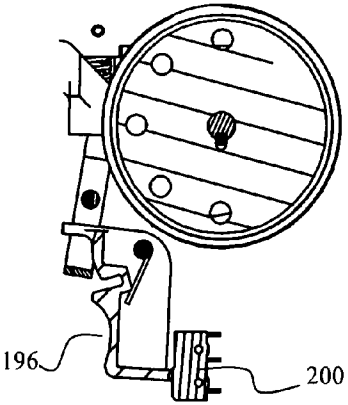
FIG. 10 depicts a partial cross sectional view of the trigger assembly of the device of FIG. 1 when the work contact element has been pressed against a work piece and the trigger or manual switch has been repositioned by a user.
Figure 9:
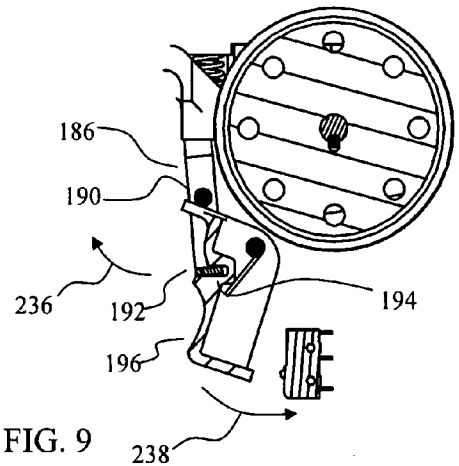
FIG. 9 depicts a partial cross sectional view of the trigger assembly of the device of FIG. 1 when the actuating mechanism is positioned as shown in FIG. 2.

Further detail and operation of the fastener impacting device 100 is described with initial reference to FIGS. 1-8. When the battery 214 is inserted into the battery receptacle 108 power is applied to the control circuit 210. Next, the operator presses the work contact element 184 against a work-piece, pushing the work contact element 184 in the direction of the arrow 234 shown in FIG. 2. The movement of the work contact element 184 causes the slide bar 182 of the actuating mechanism 180 to compress the spring 188 and to pivot the pivot arm 186 about the pivot pin 190. With reference to FIGS. 9 and 10, as the pivot arm 186 pivots about the pivot pin 190 in the direction of the arrow 236, the hook portion 192 of the pivot arm 186 rotates in the direction of the arrow 236 out of the stop slot 194. This allows the trigger 196 to be rotated in the direction of the arrow 238 to the position shown in FIG. 10. In FIG. 10, the trigger 196 is pressed against the spring loaded switch 200.

As the trigger 196 presses against the spring loaded switch 200, a signal is generated and sent to the processor 212. In response to the signal, the processor 212 causes energy from the battery 214 to be provided to the motor 114 causing the output shaft 142 of the motor 114 to rotate in the direction of the arrow 230 of FIG. 5. Accordingly, the drive wheel 140, which is fixedly attached to the output shaft 142, also rotates in the direction of the arrow 230. This rotational energy is transferred to the flywheel drive wheel 132 through the belt 138. Rotation of the flywheel drive wheel 132 causes the axle 134 and the flywheel 130 to rotate in the direction of the arrow 232.

The rotation of the flywheel 130 is sensed by the flywheel speed sensor 220 and a signal indicative of the rotational speed of the flywheel 130 is passed to the processor 212. The processor 212 controls the motor 114 to increase the rotational speed of the flywheel 130 until the signal from the flywheel speed sensor 220 indicates that a sufficient amount of kinetic energy has been stored in the flywheel 130.

In response to achieving a sufficient amount of kinetic energy, the processor 212 causes the supply of energy to the motor 114 to be interrupted, allowing the motor 114 to be freely rotated by energy stored in the rotating flywheel 130. The processor 212 further starts the timer 222 and controls the solenoid 124 to a powered condition whereby a pin 264 is forced outwardly from the solenoid 124 in the direction of the arrow 266 shown in FIG. 4, and against the pin receiving recess 152. The pin 264 thus forces the springs 148 and 150 to be compressed within the spring wells 144 and 146. As the springs 148 and 150 are compressed by the expulsion of the pin 264, the lever arm 126 rotates about the motor 114 in the direction of the arrow 266 of FIG. 6 since the lever arm 126 is rotatably connected to the frame 112 through the motor 114 and the bearing 128.

Figure 11:
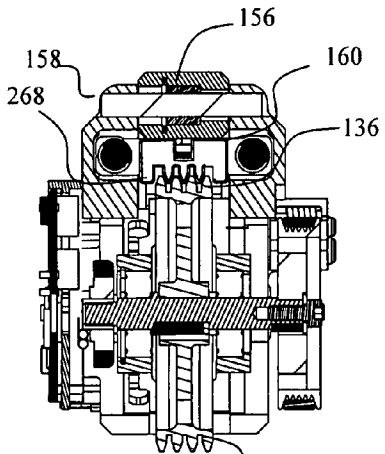
FIG. 11 depicts a partial cross sectional view of the fastener impacting device of FIG. 1 with the lever arm rotated so as to engage a drive member with the flywheel.

Rotation of the lever arm 126 forces the grooves 136 of the flywheel 130 into complimentary grooves 268 of the drive member 160 shown in FIG. 11. Accordingly, the drive member 160 is pinched between the freewheeling roller 156 and the fly wheel 130. The fly wheel 130 transfers energy to the drive member 160 and the flange 164, which is configured to abut the springs 116 and 118, presses against the springs 116 and 118, overcoming the bias of the springs 116 and 118 and forcing the drive member 160 toward the front bumper 168. While the embodiment of FIG. 11 incorporates springs, other embodiments may incorporate other resilient members in place of or in addition to the springs 116 and 118. Such resilient members may include tension springs or elastomeric materials such as bungee cords or rubber bands.

Movement of the drive member 160 along the drive path moves the anvil 162 into the drive channel 176 through the central bore 174 of the front bumper 168 so as to impact a fastener located adjacent to the drive section 110.

Figure 12:
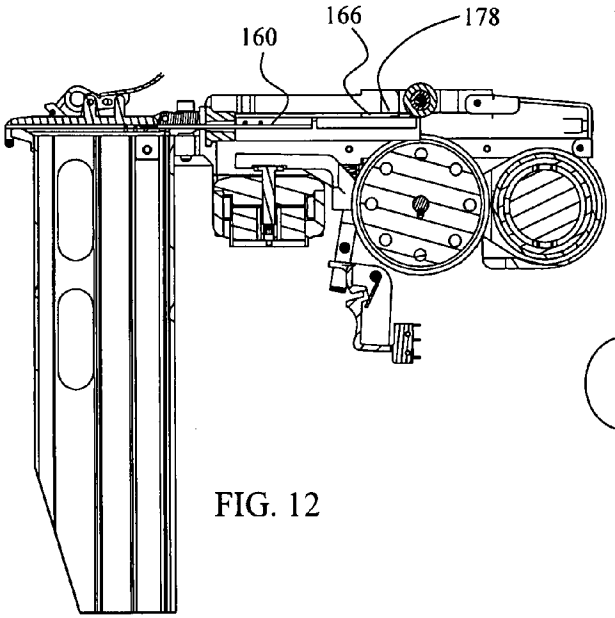
FIG. 12 depicts a partial cross sectional view of the fastener impacting device of FIG. 1 after energization of the solenoid rotates the lever arm into contact with a drive mechanism and the drive mechanism has been moved through a full stroke in accordance with principles of the invention.

Movement of the drive member 160 continues until either a full stroke has been completed or until the timer 222 has timed out. Specifically, when a full stroke is completed as shown in FIG. 12, the permanent magnet 166 is located adjacent to the Hall effect sensor 178. The sensor 178 thus senses the presence of the magnet 166 and generates a signal which is received by the processor 212. In response to the first of a signal from the sensor 178 or timing out of the timer 222, the processor 212 is programmed to interrupt power to the solenoid 124.

In alternative embodiments, the Hall effect sensor may be replaced with a different sensor. By way of example, an optical sensor, an inductive/proximity sensor, a limit switch sensor, or a pressure sensor may be used to provide a signal to the processor 212 that the drive member 160 has reached a full stroke. Depending upon various considerations, the location of the sensor may be modified. For example, a pressure switch may be incorporated into the front bumper 168. Likewise, the component of the drive member 160 which is sensed, such as the magnet 166, may be positioned at various locations on the drive member. Additionally, the sensor may be configured to sense different components of the drive member 160 such as the flange 164 or the anvil 162.

De-energization of the solenoid 124 allows the pin 264 to move back within the solenoid 124 as the energy stored within the springs 148 and 150 causes the springs 148 and 150 to expand thereby rotating the lever arm 126 in the direction opposite to the direction of the arrow 266 (see FIG. 6). The flywheel 130 is thus moved away from the drive member 160. When movement of the drive member 160 is no longer influenced by the flywheel 130, the bias provided by the springs 116 and 118 against the flange 164 causes the drive member 160 to move in a direction toward the rear bumpers 170 and 172. The rearward movement of the drive member 160 is arrested by the bumpers 170 and 172.

The solenoid 124 and lever arm 126 are thus returned to the condition shown in FIG. 4. Accordingly, prior to re-energizing the motor 114 to initiate another impacting sequence, the signal from the from the trigger switch 200 must be interrupted by releasing the trigger 196.

Figure 7:
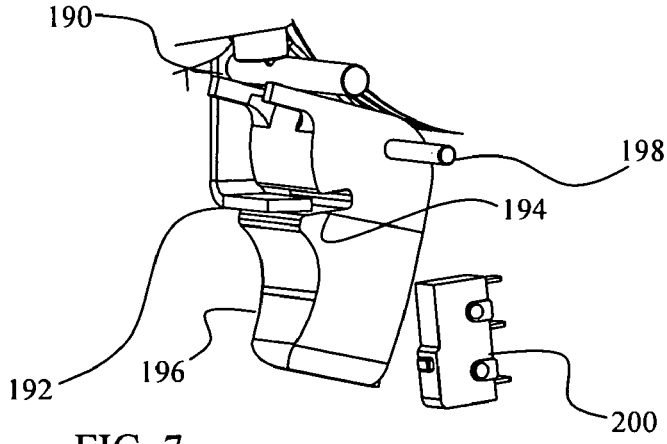
FIG. 7 depicts a partial perspective view of the device of FIG. 1 showing a trigger, a trigger sensor switch and a hook portion of a lever arm which can inhibit rotation of the trigger.

In the event that the fastener impacting device 100 is moved away from the work-piece after a fastener has been impacted and the trigger 196 has been released, the spring 188 forces the actuating mechanism 180 to return to the position shown in FIG. 2. In this position, the hook portion 192 of the pivot arm 186 is positioned within the stop slot 194 of the trigger 196 as shown in FIG. 7. In the configuration of FIG. 7, the hook portion 192 prevents rotation of the trigger 196 in the direction of the arrow 238 of FIG. 9. Accordingly, a fastener cannot be impacted before first pressing the WCE 184 against a work piece to allow operation in the manner described above.

In alternative embodiments, the processor 212 can accept a trigger input associated with the trigger 196 and a WCE input associated with the WCE 184. The trigger input and the WCE input may be provided by switches, sensors, or a combination of switches and sensors. In one embodiment, the WCE 184 no longer needs to interact with the trigger 196 via an actuating mechanism 180 including a pivot arm 186 and a hook portion 192. Rather, the WCE 184 interacts with a switch (not shown) that sends a signal to the processor 212 that indicates when the WCE 184 has been depressed. The WCE 184 may also be configured to be sensed rather than engaging with a switch. The sensor (not shown) may be an optical sensor, an inductive/proximity sensor, a limit switch sensor, or a pressure sensor.

Figure 13:
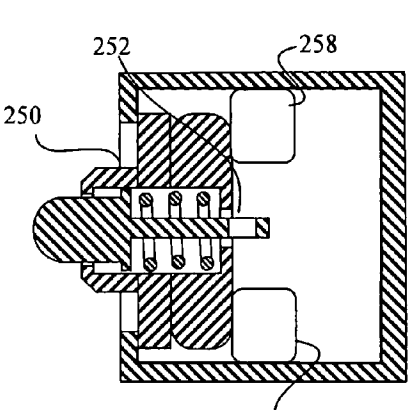
FIG. 13 depicts a partial cross sectional view of a spring loaded switch that is activated by combined positioning of the actuating mechanism and manual switch of the device of FIG. 1 so as to interact with a sensor assembly.

In this alternative embodiment, the trigger switch can include a sensor that detects the position of the trigger such as the sensor 216 shown in FIG. 13. When the trigger 196 is repositioned, a spring 250 in the spring loaded switch 200 is compressed and a stem 252 moves outwardly from the spring loaded switch 200. The trigger sensor 216 is positioned to detect movement of the stem 252.

Figure 14:
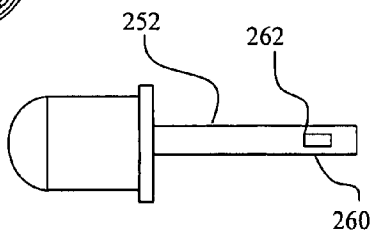
FIG. 14 depicts a side plan view of the plunger and stem of the spring loaded switch of FIG. 13.

In this embodiment, the trigger sensor 216 includes a light source 256 and a photo sensor 258. The light source 256 and the photo sensor 258 are positioned such that when the stem 252 is in the position shown in FIG. 13, a tail portion 260 (see FIG. 14) of the stem 252 blocks light from the light source 256 from reaching the photo sensor 258. When the stem 252 is moved to the right from the position shown in FIG. 13, however, a window 262 allows light from the light source 256 reach the photo sensor 258. The photo sensor 258 senses the light and provides a signal to the processor 212 indicating that the spring loaded switch 200 has been repositioned.

This alternative embodiment can operate in two different firing modes, which is user selectable by a mode selection switch (not shown). In a sequential operating mode, depression of the WCE 184 causes a WCE signal, based upon a switch or a sensor, to be generated. In response, the processor 212 executes program instructions causing battery power to be provided to the motor 114. The processor 212 may also energize the sensor 216 based upon the WCE signal. When the flywheel speed sensor 220 indicates a desired amount of kinetic energy has been stored in the flywheel 130, the processor 212 then controls the motor 114 to maintain the rotational speed of the flywheel 130 that corresponds to the kinetic energy desired.

If desired, an operator may be alerted to the status of the kinetic energy available. By way of example, the processor 212 may cause a red light (not shown) to be energized when the rotational speed of the flywheel 130 is lower than the desired speed and the processor 212 may cause a green light (not shown) to be energized when the rotational speed of the flywheel 130 is at or above the desired speed.

In addition to causing energy to be provided to the motor 114 upon depression of the WCE 184, the processor 212 starts a timer when battery power is applied to the motor 114. If a trigger signal is not detected before the timer times out, battery power will be removed from the motor 114 and the sequence must be restarted. The timer 222 may be used to provide a timing signal. Alternatively, a separate timer may be provided.

If the trigger 196 is manipulated, however, the processor 212 receives a trigger signal from the trigger switch or trigger sensor 216. The processor 212 then causes the supply of energy to the motor 114 to be interrupted, as long as the kinetic energy in the flywheel 130 is sufficient, allowing the motor 114 to be freely rotated by energy stored in the rotating flywheel 130. The processor 212 further starts the first timer 222 and controls the solenoid 124 to a powered condition. In response to the first of a signal from the driver block sensor 178 or timing out of the timer 222, the processor 212 is programmed to interrupt power to the solenoid 124. Both the WCE switch/sensor and the trigger switch or trigger sensor 216 must be reset before another cycle can be completed.

Alternatively, an operator may select a bump operating mode using the mode selection switch. In embodiments incorporating a trigger sensor, positioning of the selection switch in the bump mode setting causes the trigger sensor to be energized. In this mode of operation, the processor 212 will supply battery power to the motor 114 in response to either the WCE switch/sensor signal or the trigger switch/sensor signal. Upon receipt of the remaining input signal, the processor 212 verifies that the desired kinetic energy is stored in the flywheel 130 and then causes the supply of power to the motor 114 to be interrupted and the battery power is supplied to the solenoid 124. In response to the first of a signal from the driver block sensor 178 or timing out of the timer 222, the processor 212 is programmed to interrupt power to the solenoid 124.

In bump operating mode, only one of the two inputs must be reset. The processor 212 will supply battery power to the motor 114 immediately after the solenoid power is removed as long as at least one of the inputs remains activated when the other input is reset. When the reset input again provides a signal to the processor 212, the sequence described above is once again initiated.

Figures 15, 16, 17:
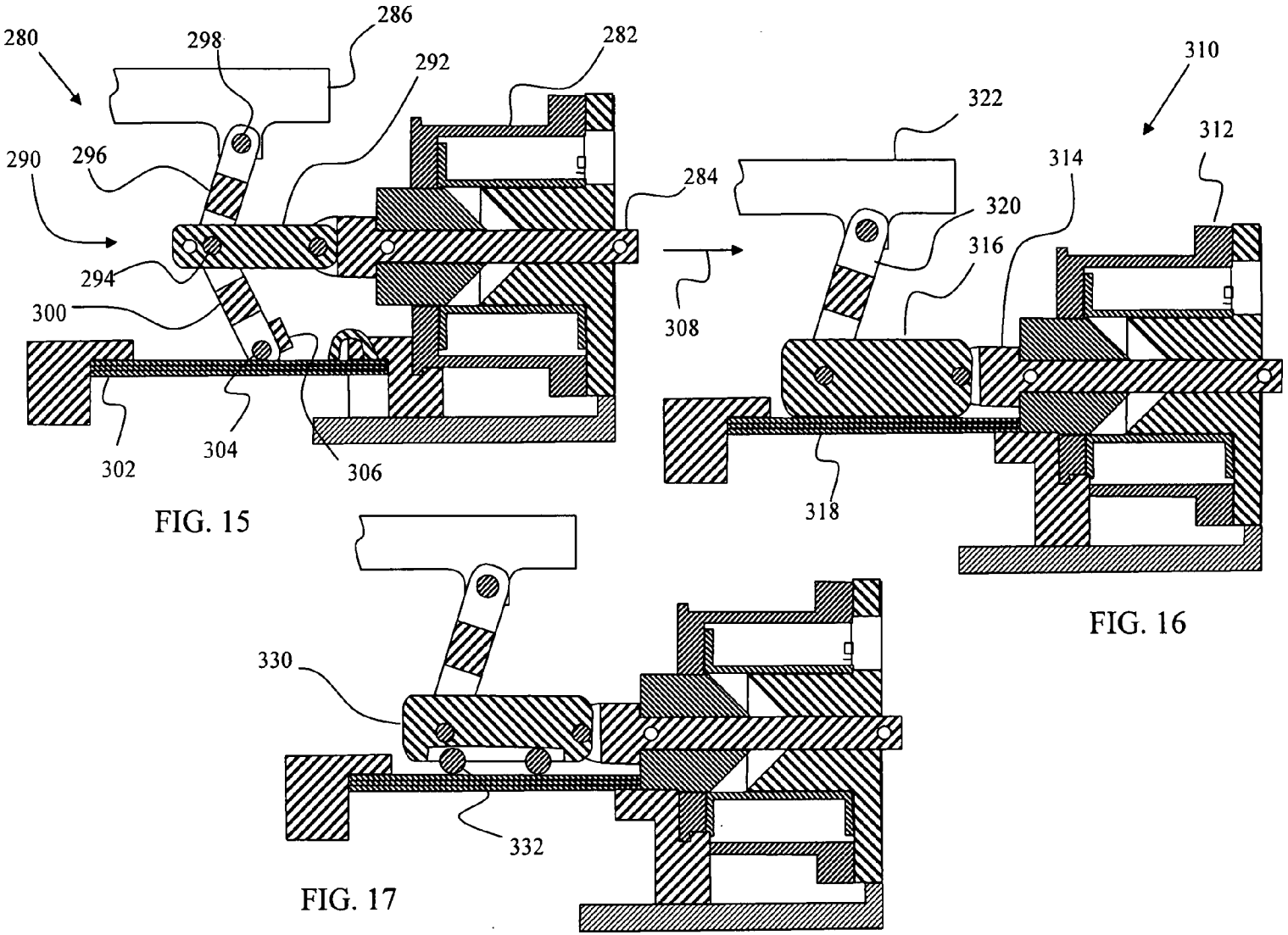
FIG. 15 depicts a partial cross sectional view of a fastener impacting device incorporating a solenoid mechanism with a knee hinge to provide a mechanical advantage in pivoting a lever arm assembly.
FIG. 16 depicts a partial cross sectional view of a device with a solenoid activated lever arm which is positioned using a sled sliding on a surface.
FIG. 17 depicts a partial cross sectional view of a solenoid activated lever arm which is positioned using a sled provided with wheels that roll on a surface.

An alternative solenoid assembly is shown in FIG. 15. The solenoid assembly 280 may be used in a fastener impacting device which is substantially the same as the fastener impacting device 100. The solenoid assembly 280 includes a solenoid 282 which is oriented with a pin 284 that moves along an axis somewhat parallel to the tongue 286 of a lever arm assembly (not otherwise shown) configured like the lever arm assembly 126. The pin 284 is connected to a knee hinge 290 through a shaft 292 and a pin 294. The knee hinge 290 includes an upper arm 296 which is rotatably connected to the tongue 286 through a pin 298 and a lower arm 300 which is rotatably connected to a frame portion 302 through a pin 304. A stop 306 is located on the lower arm 300.

Operation of a fastener impacting device with the solenoid assembly 280 is substantially the same as operation of the fastener impacting device 100. The main difference is that when the solenoid 282 is controlled to a powered condition, the pin 284 is pulled into the solenoid 282 thereby causing the shaft 292 to move in the direction of the arrow 308 shown in FIG. 15. The shaft 292 pulls the knee hinge 290 in the direction of the arrow 308.

Because the upper arm 296 of the knee hinge 290 is pivotably connected to the tongue 286 through the pin 298, and the lower arm 300 of the knee hinge 290 is pivotably connected to the frame portion 302 through the pin 304, the knee hinge 290 is forced toward an extended condition. In other words, the upper arm 296 pivots in a counter-clockwise direction about the pin 298 while the lower arm 300 pivots in a clockwise direction about the pin 304. Extension of the knee hinge 290 causes rotation of the lever arm assembly 288 about a pivot in a manner similar the rotation of the lever arm assembly 126.

An alternative solenoid mechanism is depicted in FIG. 16. The solenoid mechanism 310 includes a solenoid 312 with a solenoid pin 314. The solenoid pin 314 is operatively connected to a sled 316 positioned on a slide 318. An arm 320 is pivotably connected to the sled 316 at one end and to a lever arm 322 at the other end.

The solenoid mechanism 310 operates in a fastener impacting device in substantially in the same manner as the solenoid mechanism 280. The main difference is that in place of a knee hinge such as the knee hinge 290, the solenoid mechanism 310 includes the sled 316. Accordingly, energization of the solenoid 312 causes the sled 316 to move across the slide 318, thereby forcing the lever arm 322 to rotate. In a further embodiment, frictional forces are reduced by providing a sled 330 with wheels 332 as shown in FIG. 17.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

The invention claimed is:

1. A device for impacting a fastener comprising:

a drive mechanism configured to impact a fastener;

a flywheel pivotable between a first flywheel position whereat the flywheel is not in contact with the drive mechanism and a second flywheel position whereat the flywheel contacts the drive mechanism;

a motor operably connected to the flywheel for storing energy in the flywheel;

a trigger movable between a first released trigger position and a second trigger position; and a work contact element (WCE) assembly movable between a first released WCE position and a second WCE position, the WCE assembly configured such that (i) when the trigger is in the first released trigger position and the WCE assembly is in the first released WCE position, the WCE assembly mechanically engages the trigger to preclude movement of the trigger out of the first released trigger position, and (ii) when the WCE assembly is in the second WCE assembly position, the WCE assembly does not mechanically engage the trigger.

2. The device of claim 1, further comprising:

a memory including program instructions; and a processor operably connected to the memory for executing the program instructions to (i) energize the motor based upon the WCE position, and (ii) control the flywheel to pivot between the first flywheel position and the second flywheel position based upon the trigger position.

3. The device of claim 2, further comprising:

a solenoid configured to pivot the flywheel between the first flywheel position and the second flywheel position.

4. The device of claim 1, wherein:

the trigger comprises stop slot; and the WCE assembly comprises a hook member, the hook member movable between a first hook position whereat the hook can be positioned within the stop slot and a second hook position whereat the hook cannot be positioned within the stop slot.

5. The device of claim 4, wherein the hook member is pivotable between the first hook position and the second hook position.

6. The device of claim 5, further comprising:

a memory including program instructions; and a processor operably connected to the memory for executing the program instructions to (i) energize the motor based upon the WCE position, and (ii) control the flywheel to pivot between the first flywheel position and the second flywheel position based upon the trigger position.

7. The device of claim 6, further comprising:

a solenoid configured to pivot the flywheel between the first flywheel position and the second flywheel position.

8. The device of claim 1, wherein the WCE assembly comprises an inductive sensor.

9. A device for impacting a fastener comprising:

a solenoid configured to pivot a lever arm between a first position whereat a flywheel is spaced apart from a drive mechanism that is configured to impact a fastener and a second position whereat the flywheel can contact the drive mechanism;

a motor operably connected to the flywheel for storing energy in the flywheel;

a trigger movable between a first released trigger position and a second trigger position; and a work contact element (WCE) assembly movable between a first released WCE position whereat the trigger is mechanically engaged by the WCE assembly to preclude movement of the trigger from the first released trigger position and a second WCE position whereat the WCE assembly does not engage the trigger.

10. The device of claim 9, further comprising:

a memory including program instructions; and a processor operably connected to the memory for executing the program instructions to (i) energize the motor, and (ii) energize the solenoid to pivot the lever arm to the second position based upon positioning the trigger in the second trigger position.

11. The device of claim 10, further comprising:

a sensor configured to generate a trigger position signal based upon positioning the trigger in the second trigger position.

12. The device of claim 10, further comprising:

a WCE sensor assembly for providing a signal to the processor indicative of the position of the WCE assembly.

13. The device of claim 9, wherein the WCE assembly comprises:

a hook portion for pivoting into a slot in the trigger.

* * * * *